US005259070A

United States Patent [19]

De Roza

[11] Patent Number: 5,259,070

[45] Date of Patent: Nov. 9, 1993

[54] PROTECTIVE HELMET KIT APPARATUS

[76] Inventor: Kort J. De Roza, 1527 Pine, San Francisco, Calif. 94109

[21] Appl. No.: 859,941

[22] Filed: Mar. 30, 1992

[51] Int. Cl.[5] ..... A42B 3/02; A41D 13/00; B60R 21/22

[52] U.S. Cl. ..... 2/413; 2/93; 2/DIG. 10; 280/730

[58] Field of Search ..... 2/413, 411, 424, 425, 2/2, DIG. 3, DIG. 10, 6, 93; 280/728, 730

[56] References Cited

U.S. PATENT DOCUMENTS 4,324,005 4/1982 Willis ..... 2/413
4,602,385 7/1986 Warren ..... 2/2
4,984,821 1/1991 Kim et al. ..... 2/2 X
5,091,992 3/1992 Pusic ..... 2/DIG. 3 X

*Primary Examiner*—Peter Nerbun
*Attorney, Agent, or Firm*—Leon Gilden

[57] ABSTRACT

A helmet kit includes a pneumatically inflatable flexible helmet having a visor mounted thereto in a pivotal relationship. The kit is arranged to include a torso, pants, and arm protective padding in use to afford protection to motorcycle riders. The helmet structure is arranged to include an inflation canister selectively operative to direct compressed gas into a pneumatic chamber within the helmet and is coextensive with the helmet to afford protection to a user of the helmet structure.

4 Claims, 5 Drawing Sheets

PROTECTIVE HELMET KIT APPARATUS

BACKGROUND OF THE INVENTION

1. Field of the Invention

The field of invention relates to motorcycle protective garment structure, and more particularly pertains to a new and improved protective helmet kit apparatus wherein the same is directed to afford protection to riders of motorcycles.

2. Description of the Prior Art

Due to comfort and restrictiveness of conventional rigid helmet structure, a number of motorcycle enthusiasts are reluctant to employ protective structure in the operation of a motorcycle vehicle. To overcome deficiencies of the prior art, the instant invention addresses the use of a flexible protective gear structure to afford protection to motorcycle riders to encourage safety in use of such structure. Prior art shock-absorbing garments are exemplified in U.S. Pat. No. 4,602,385 to Warren setting forth a protective vest structure affording protection to a torso portion of an individual.

U.S. Pat. No. 4,062,067 to Franzen sets forth a protective head gear utilizing a plurality of transverse cushion head bands mounted about an individual.

U.S. Pat. No. 4,847,921 to Leutholt, et al. sets forth a protective head gear for use by boxers and the like having multi-layered padded bands extending across a facial portion of the individual.

U.S. Pat. No. 3,991,422 to Saotome sets forth a defensive covering for a head having a plurality of arc shaped rigid straps arranged for pivotal relationship relative to one another to open to a helmet type construction.

As such, it may be appreciated that there continues to be a need for a new and improved protective helmet kit apparatus as set forth by the instant invention which addresses both the problems of ease of use as well a effectiveness in construction and in this respect, the present invention substantially fulfills this need.

SUMMARY OF THE INVENTION

In view of the foregoing disadvantages inherent in the known types of protective apparatus now present in the prior art, the present invention provides a protective helmet kit apparatus wherein the same is arranged to afford protection to various body parts in use. As such, the general purpose of the present invention, which will be described subsequently in greater detail, is to provide a new and improved protective helmet kit apparatus which has all the advantages of the prior art protective helmet structure and none of the disadvantages.

To attain this, the present invention provides a helmet kit including a pneumatically inflatable flexible helmet having a visor mounted thereto in a pivotal relationship. The kit is arranged to include a torso, pants, and arm protective padding in use to afford protection to motorcycle riders. The helmet structure is arranged to include an inflation canister selectively operative to direct compressed gas into a pneumatic chamber within the helmet and is coextensive with the helmet to afford protection to a user of the helmet structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved protective helmet kit apparatus which has all the advantages of the prior art protective helmet structure and none of the disadvantages.

It is another object of the present invention to provide a new and improved protective helmet kit apparatus which may be easily and efficiently manufactured and marketed.

It is a further object of the present invention to provide a new and improved protective helmet kit apparatus which is of a durable and reliable construction.

An even further object of the present invention is to provide a new and improved protective helmet kit apparatus which is susceptible of a low cost of manufacture with regard to both materials and labor, and which accordingly is then susceptible of low prices of sale to the consuming public, thereby making such protective helmet kit apparatus economically available to the buying public.

Still yet another object of the present invention is to provide a new and improved protective helmet kit apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
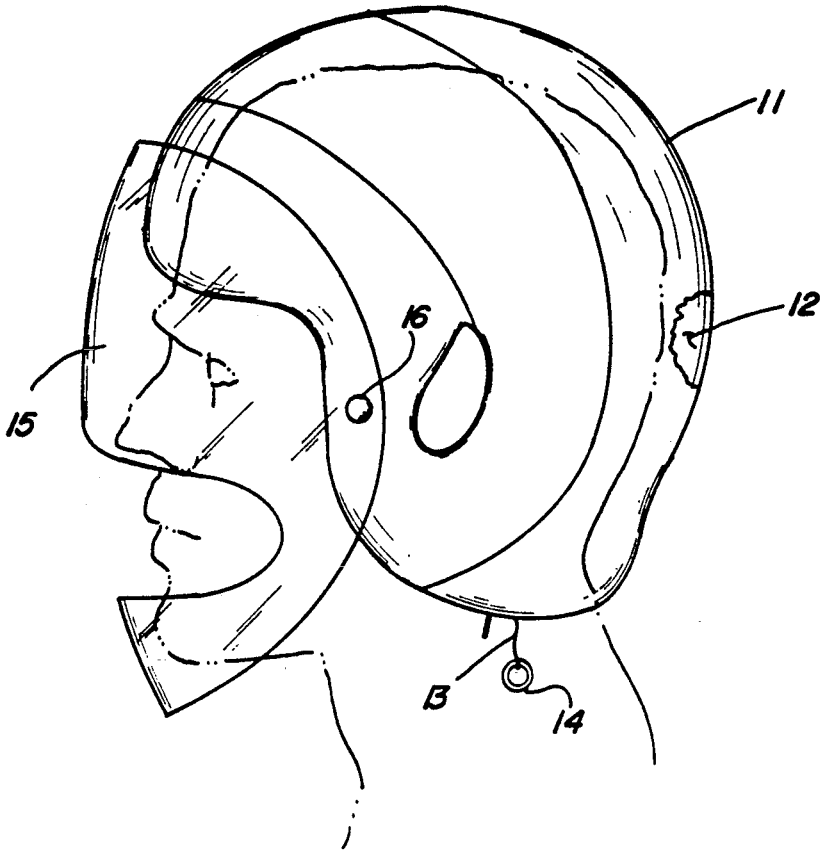
FIG. 1 is an orthographic side view of the helmet structure.

With reference now to the drawings, and in particular to FIGS. 1 to 12 thereof, a new and improved protective helmet kit apparatus embodying the principles and concepts of the present invention and generally designated by the reference numeral 10 will be described.

Figure 2:
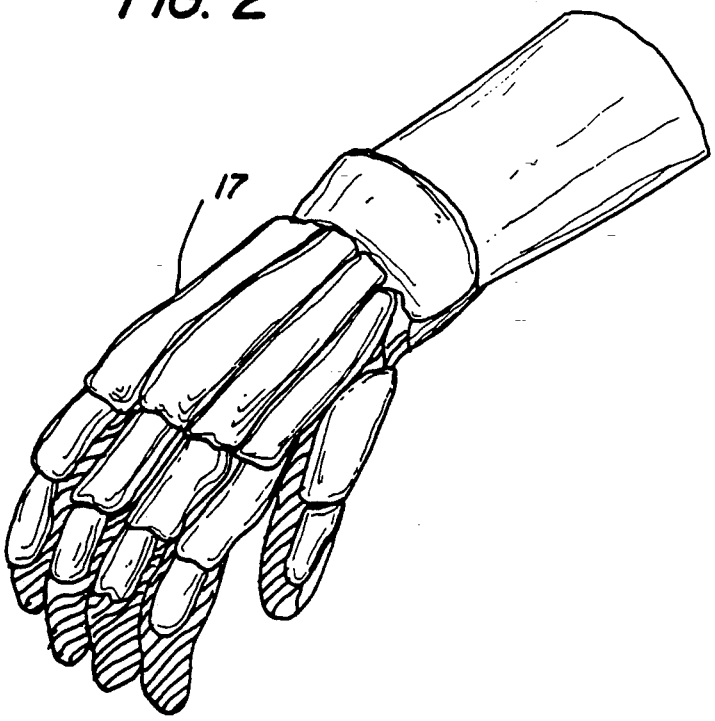
FIG. 2 is an isometric illustration of a glove structure for use by the invention.
Figure 3:
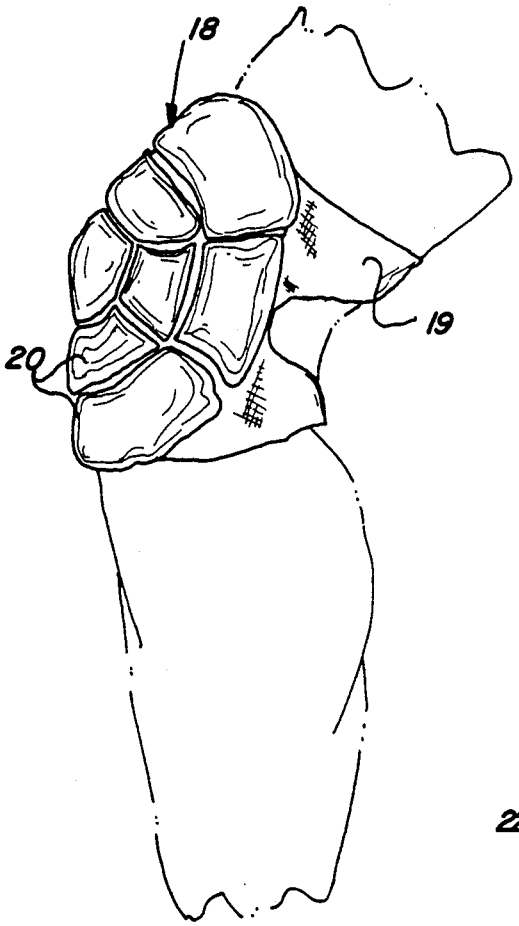
FIG. 3 is an isometric illustration of a protective knee pad structure utilized by the invention.
Figure 4:
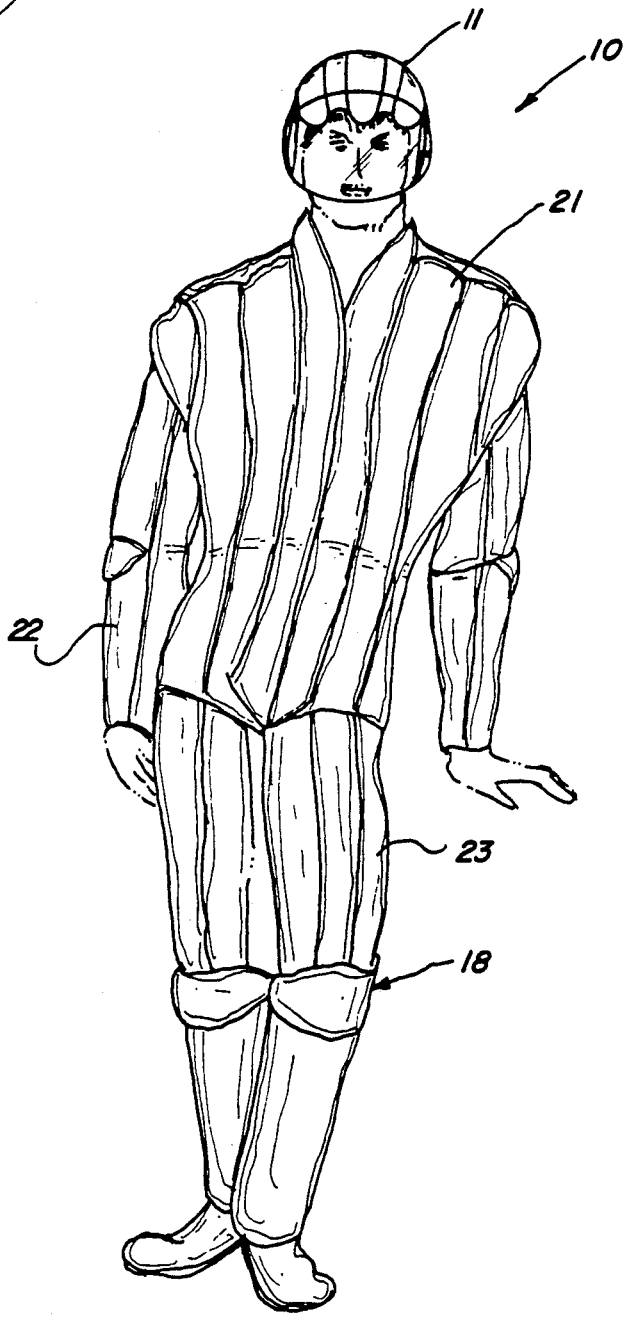
FIG. 4 is an orthographic view of the invention.

More specifically, the protective helmet kit apparatus 10 of the instant invention essentially comprises a flexible helmet member 11 having a pneumatic chamber 12 coextensive with the helmet 11 arranged for selective inflation to afford protection to a user of the helmet structure. An actuator cord 13 is provided formed with a pull ring 14 at a free distal end of the cord 13 to effect actuation of an inflation mechanism, to be described in more detail below and illustrated in the FIGS. 7 and 8. A visor 15 is pivotally mounted about visor pivots 16 to afford facial protection to an individual thereof. The organization is further contemplated to employ padded glove members 17, of a type as illustrated in FIG. 2, in cooperation with knee pad members 18 having elastomeric tubular web base 19 formed with padded segments 20 about a forward surface of the web 19 to permit articulation of the knee portion with limited restriction to a user thereof. A torso jacket 21 is provided, as illustrated in FIG. 4, to include padded sleeve members 22 and to further be provided with padded pant members 23.

Figure 5:
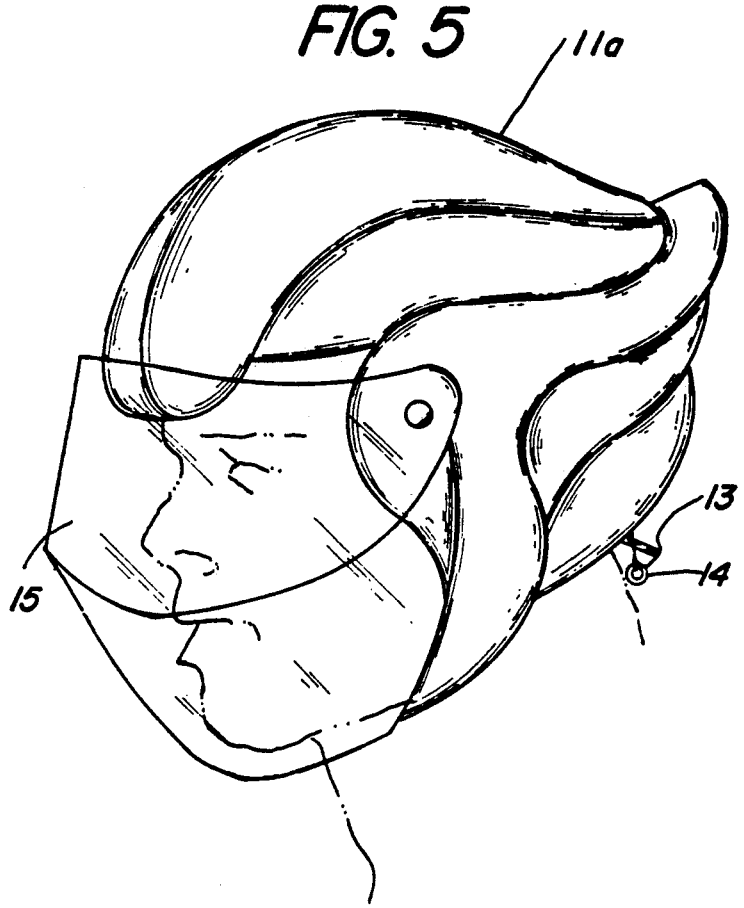
FIG. 5 is an orthographic side view of a further configured helmet structure.
Figure 6:
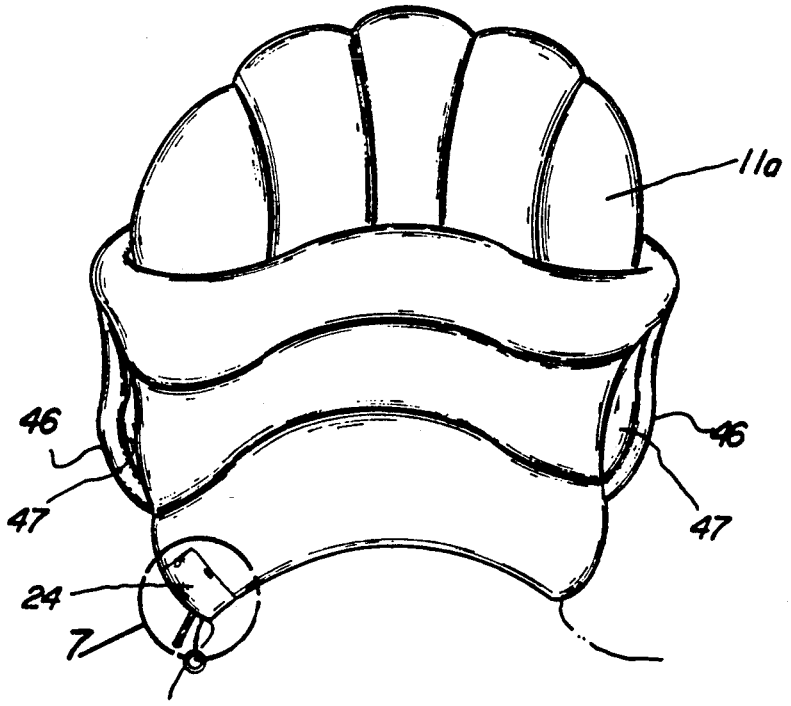
FIG. 6 is an orthographic rear view of the helmet structure.
Figure 7:
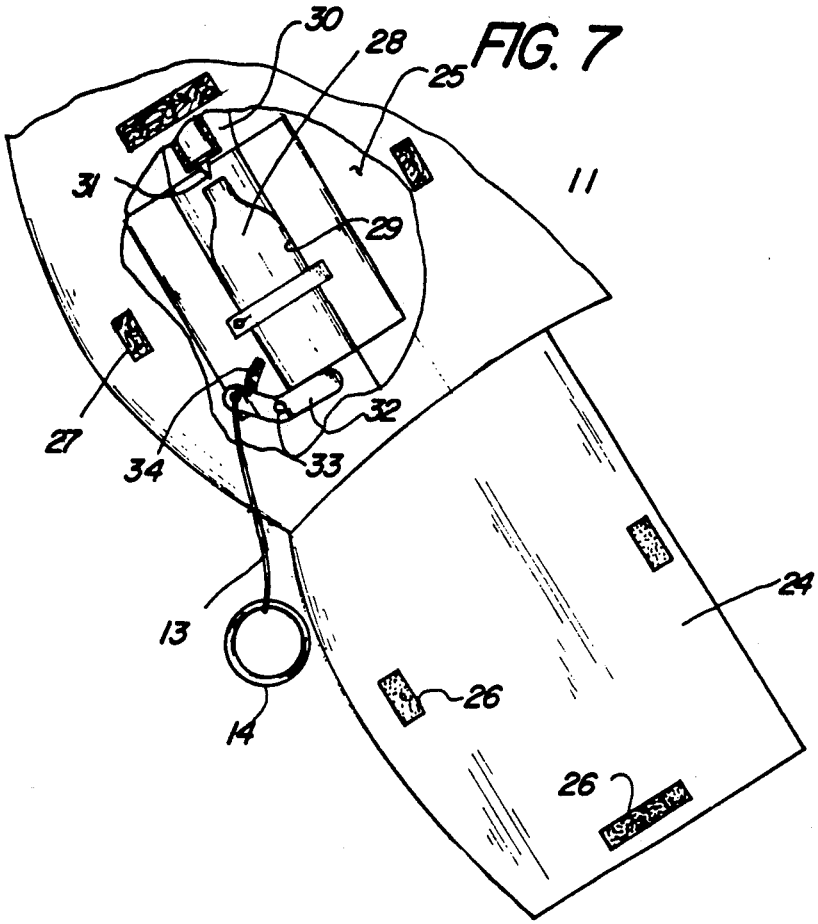
FIG. 7 is an orthographic view of section 7 as set forth in FIG. 6.

The FIG. 5 illustrates a modified helmet structure 11*a* formed with cover ear flaps 46, with each ear flap 46 positioned above an ear chamber 47 to afford baffled protection to an individual in utilization of the helmet structure 11*a*.

A compartment cover flap 24 is hingedly mounted to the helmet member 11, and includes cover flap hook and loop patches 26 cooperative with helmet hook and loop patches 27 to afford access to a compartment chamber 25 within the helmet structure. A compressed gas canister 28 is received within a canister chamber 29 in a complementary configuration, with a pneumatic conduit 30 directed into the pneumatic chamber 12. A piercing tip 31 positioned coaxially of the pneumatic conduit 30 and an angulated lever plate 32 includes a lever plate axle 33 pivotally mounting the generally V-shaped lever medially of the legs of the V-shaped lever plate 32. A forward end of the lever plate 32 is positioned below and in contiguous communication with the canister 28, wherein a rear end portion of the lever plate 32 includes the actuator cord 13 mounted thereto. A spring member 34 positioned in abutment with the rear end portion of the lever plate 32 above the lever plate axle 33 maintains biased communication of the forward end portion of the lever plate with the bottom surface of the canister 28. Alternatively, an inflation tube 35 having a tube cap 36 directed into pneumatic communication with the pneumatic chamber 12 is provided in the event of failure of the compressed gas canister or unavailability of such canister in use.

Figure 8:
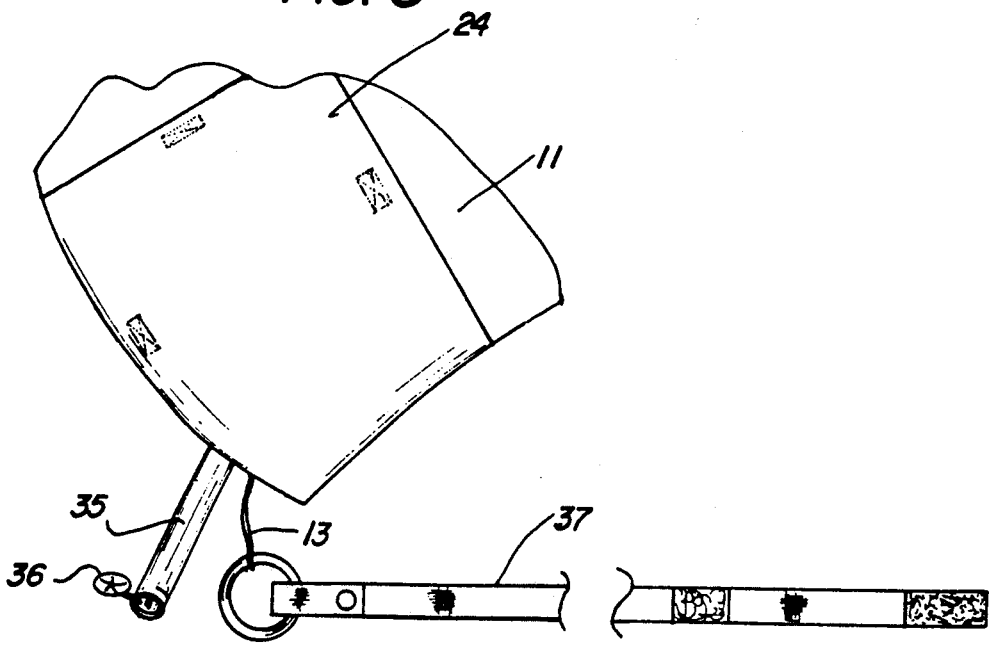
FIG. 8 is an orthographic view of the pneumatic compartment in a closed configuration.
Figure 9:
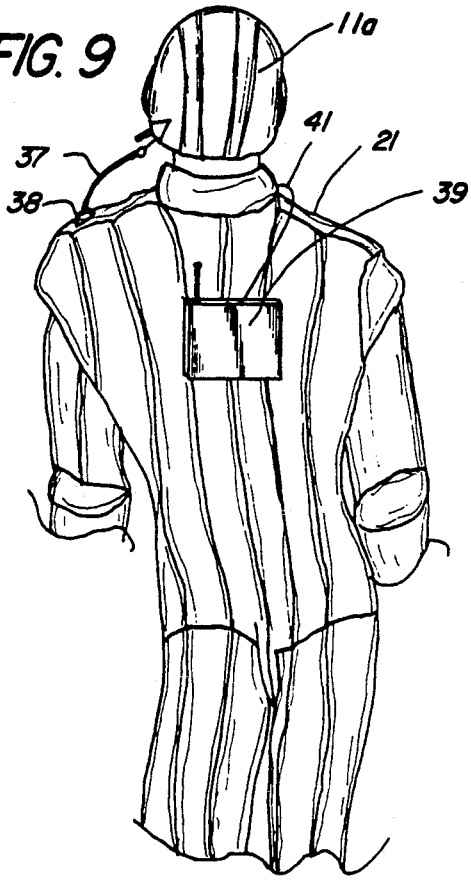
FIG. 9 is an orthographic side view of the torso protective structure having a radio transmitter mounted thereto.

The FIGS. 8 and 9 further illustrate the use of a strap member 37 secured between the pull ring 14 and a shoulder loop 38 mounted to a shoulder portion of the torso jacket 21. In this manner, upon sudden impacting of an individual utilizing the structure, tensioning of the strap member 38 due to head movement by an individual having the helmet member 11 or 11*a* mounted thereon effects actuation of the compressed gas canister structure for inflation of the pneumatic chamber 12.

Figure 10:
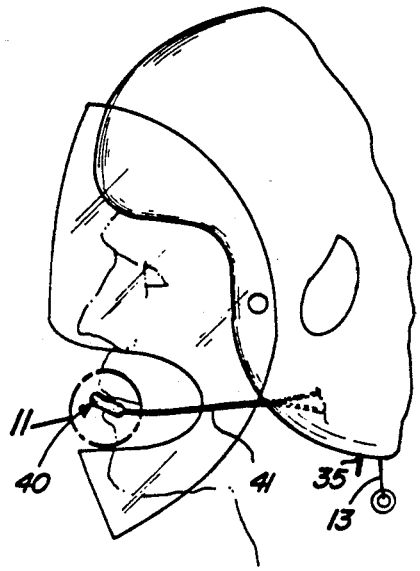
FIG. 10 is an orthographic side view of the switch assembly utilized by the invention.
Figure 11:
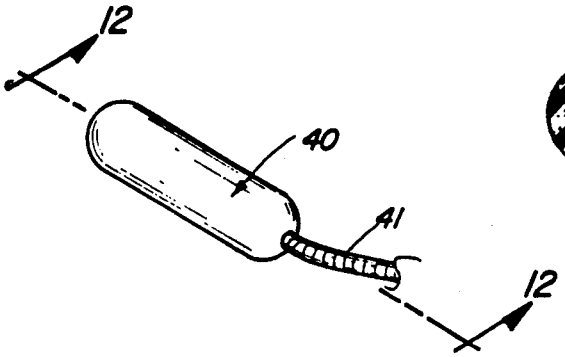
FIG. 11 is an isometric illustration of the switch assembly.
Figure 12:
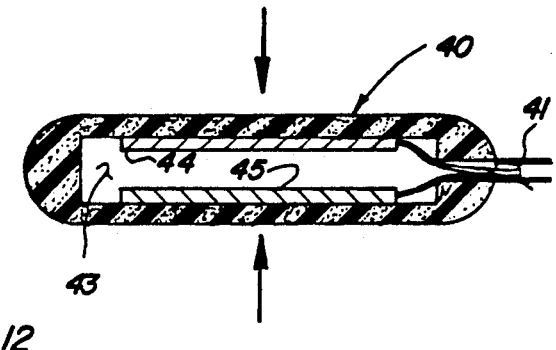
FIG. 12 is an orthographic view, taken along the lines 12—12 of FIG. 11 in the direction indicated by the arrows.

The FIGS. 10–12 further illustrate the use of a transmitter switch 40 arranged for oral securement for selective actuation of a signal transmitter 39. To this end, a closed resilient cushioned capsule 42 formed of a shape retentent material includes a capsule chamber 43 contained therewithin, wherein first and second switch plates 44 and 45 are spaced apart on opposed sides of the capsule chamber 43, whereupon sudden biting of the capsule 40 to effect electrical communication between the first and second switch plates 44 and 45 whereupon the electrical transmission line 41 in communication with the transmitter 39 effects simultaneous generation of a transmitter signal from a transmitter of a conventional type. In this manner should a rider be rendered unconscious, a signal would be generated to note location of the rider of the organization relative to a remote receiver (not shown) of a conventional transmitter receiver cooperative structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A protective helmet kit apparatus, comprising, a flexible helmet member, and a padded torso jacket, wherein the helmet member includes a pneumatic chamber coextensive with the helmet member, and pneumatic means mounted within the helmet member in pneumatic communication with the pneumatic chamber for effecting selective inflation of the pneumatic chamber, and a compartment chamber is mounted within the helmet member adjacent the pneumatic chamber, the compartment chamber includes a compressed gas canister chamber, and a compressed gas canister complementarily received within the compressed gas canister chamber, and a pneumatic conduit directed to the compressed gas canister, with the pneumatic conduit including a piercing tip coaxially aligned within the pneumatic conduit positioned adjacent a forward distal end of the compressed gas canister, and an angulated lever plate mounted in contiguous communication with a lower distal end of the compressed gas canister, with the angulated lever plate including a lever plate axle pivotally mounting the lever plate, and a forward distal end of the lever plate positioned in contiguous communication with the gas canister, and a rear end portion of the lever plate having a flexible pull cord mounted thereto, the pull cord including a pull ring mounted to a free distal end of the pull cord spaced from the lever plate, and a spring member mounted in communication with the rear end portion of the lever plate to bias the lever plate in contiguous communication with the compressed gas canister.

2. An apparatus as set forth in claim 1 including a flexible cover flap mounted over the compartment chamber, the cover flap including a plurality of cover flap hook and loop fastener patches, and the helmet member including a plurality of helmet hook and loop fastener patches positioned in surrounding relationship relative to the compartment chamber for securement to the cover flap hook and loop fastener patches.

3. An apparatus as set forth in claim 2 wherein the torso jacket includes a loop member, the loop member and the pull ring including a strap member interconnecting the loop member and the pull ring.

4. An apparatus as set forth in claim 3 wherein the torso jacket includes a signal transmitter mounted thereto, and a transmitter switch positioned within the helmet member in electrical communication with the signal transmitter, the transmitter switch including an enclosed resilient cushion capsule formed of a shape retentive member, with the capsule including a capsule chamber therewithin, and a first switch plate and a second switch plate spaced apart within the capsule chamber arranged for communication of the first switch plate with the second switch plate upon oral deflection of the first switch plate towards the second switch plate to effect actuation of the transmitter.

* * * * *